United States Patent [19]

Hosono et al.

[11] Patent Number: 4,482,239

[45] Date of Patent: Nov. 13, 1984

[54] IMAGE RECORDER WITH MICROWAVE FIXATION

[75] Inventors: Nagao Hosono, Chofu; Kazuo Isaka, Kawasaki, both of Japan

[73] Assignee: Canon Kabushiki Kaisha, Tokyo, Japan

[21] Appl. No.: 369,744

[22] Filed: Apr. 19, 1982

[30] Foreign Application Priority Data

Apr. 25, 1981 [JP] Japan ..... 56-62956
Apr. 25, 1981 [JP] Japan ..... 56-62957

[51] Int. Cl.[3] ..... G03G 15/20

[52] U.S. Cl. ..... 355/3 FU; 219/216; 219/388; 219/10.55 A; 430/110

[58] Field of Search ..... 355/3 FU, 14 FU; 219/216, 388, 10.55 R, 10.55 A, 10.55 M; 430/109, 111

[56] References Cited

U.S. PATENT DOCUMENTS 3,851,132 11/1974 Vankoughnett ..... 219/10.55 A 4,202,618 5/1980 Waschk et al. ..... 355/3 FU

OTHER PUBLICATIONS

*Xerox Disclosure Journal*, "Toner Fusion Using R.F. Fields and Utilizing Curie Temperature of Toner Additive", vol. 2, No. 2, Mar./Apr. 1977.

*Primary Examiner*—R. L. Moses

*Attorney, Agent, or Firm*—Fitzpatrick, Cella, Harper & Scinto

[57] ABSTRACT

The present invention is directed to improvement in an image recorder for recording developed images or toner images by microwave fixation. According to the invention there is used a novel thermoplastic developer comprising of two components. The first component contains a dielectric material which is able to absorb microwave and generate heat by dielectric loss. The second component contains magnetic loss exothermic material. The microwave absorbing power of the first component is improved by heating the first component with heat generated from the second component.

27 Claims, 7 Drawing Figures

IMAGE RECORDER WITH MICROWAVE FIXATION

BACKGROUND OF THE INVENTION

1. Field of the Invention

The present invention relates to methods and apparatus for forming images including the steps of visualizing electrostatic latent images or magnetic images with developer and recording the visualized images on a recording material by microwave fixing. The steps are carried out in accordance with a known image forming method such as an electrophotographic process an, electrostatic recording process or a magnetic recording process. The term "microwave" as used herein is to be understood to mean those electromagnetic waves whose wavelength is less than several meters and to include also sub-millimeter region waves having wavelength less than 1 mm close to the far infrared region.

2. Description of the Prior Art

A copying apparatus provided with a microwave dielectric heating fixing system is already known in the art. In this type of copying machines microwaves are used for fixing. This has a particular advantage that a wait time is no longer required to warm up fixing rollers and other members, and further there is no problem of offset. The microwave dielectric heating fixing method according to the prior art uses a dielectric material that is able to absorb and generate heat. Such dielectric material is admixed with thermoplastic developer in order to make full use of microwave radiation. The dielectric developer is introduced into a high frequency electric field to induce a polarization oscillation within the dielectric material thereby transforming microwave radiation into thermal energy. The thermal energy melts the main component resin of the developer, a thermoplastic resin, whereby the developed image is fixed on the recording material.

As will be understood from the above, if there is used, as the dielectric material in the developer or in the developed image, such material which has a higher microwave dielectric loss, then a substantial improvement in microwave absorption and therefore a substantial improvement in fixability can be attained.

However, until now, a suitable resin has not been available which can satisfy the requirements of high dielectric loss and low melting point at the same time. For this reason, a mixture of two different materials has been used as the developer for microwave fixing. The mixture contains material of high dielectric loss and material of low melting point.

Resin having higher dielectric loss is more exothermic. In the mixture, the heat generated from the resin of high dielectric loss by microwave is transmitted to another component resin of low melting point through surface-surface contact of the two materials. Use of a high content of the resin of high dielectric loss is limited by the heat transmission time. If the content is high, the heat transmission time becomes long. Therefore, it is very difficult to obtain a developer which exhibits good fixativeness in a short time. There has not been developed yet any developer having satisfactory thermal efficiency.

As another attempt to improve the fixativeness of such developer, the amount of microwave radiation has been increased. But, this attempt has resulted in failure. Increase of microwave output has increased only the quantity of wasted microwave radiation. The increased microwave radiation was used in vain.

The most important problem in microwave heating fixing system is, therefore, how to efficiently convert microwave radiation into fixing energy. Now, there is an increasing demand for a novel technique by which the fixativeness and fixing speed can be improved.

SUMMARY OF THE INVENTION

Accordingly it is the principal object of the present invention to provide an effective solution to the above mentioned problem and provide a practically useful image recording apparatus based on the novel solution.

More specifically, it is an object of the invention to provide an image recording apparatus which has improved microwave fixing efficiency. The developer conventionally used in the above mentioned type of image recording apparatus has contained such component which acts to reduce the fixativeness. Magnetic powder is one example of such component. According to this invention, such component is transformed into useful material for improvement of fixativeness thereby improving the microwave fixing efficiency.

It is another object of the invention to provide an image recording apparatus which improves not only the microwave fixativeness but also recording speed.

It is a further object of the invention to provide an image recording apparatus with which microwave radiation can be converted into fixing energy at improved conversion efficiency. According to the invention, this object is attained by improving the microwave absorbing power of the developer by the heat generating action of a developer component which is magnetic loss exothermic.

Other and further objects, features and advantages of the invention will appear more fully from the following description taken in connection with the accompanying drawings.

DESCRIPTION OF THE PREFERRED EMBODIMENTS

Figure 1:
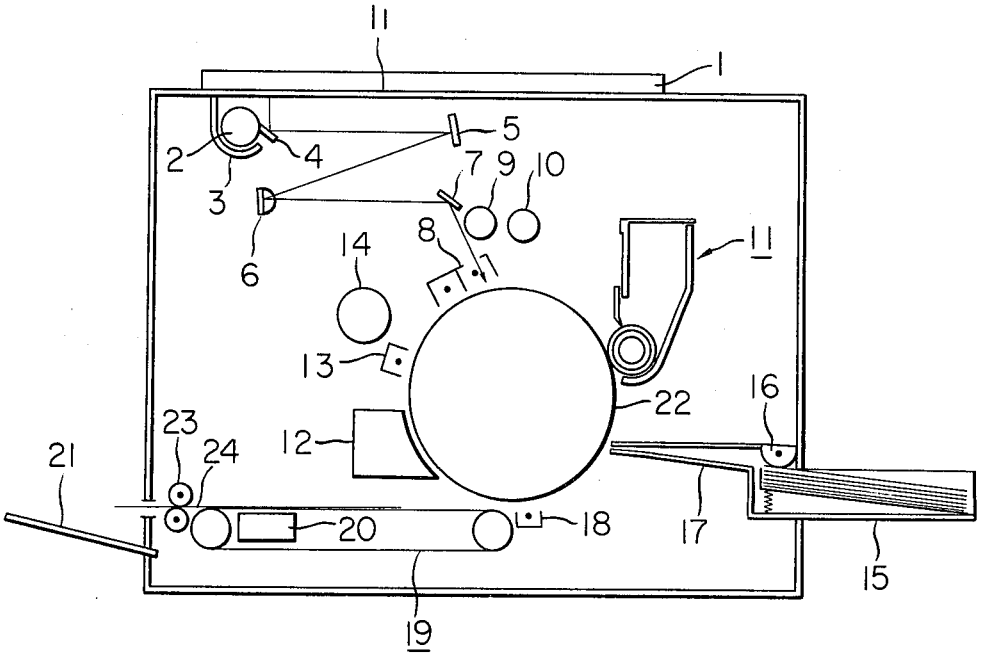
FIG. 1 is a schematic view of an embodiment of the invention.

FIG. 1 is a schematic view of an electrophotographic copying machine in which the present invention is embodied.

Designated by 1 is a cover member covering an original carriage $\mathbf{1}_1$. An original (not shown) is placed on the original carriage and is held in the position by the cover member 1. Reference numeral 22 is a photosensitive drum. To scan the original on the carriage, any suitable optical means such as moving optical scanning means or stationary optical scanning means is provided. Through said optical means an optical image of the original is projected on the photosensitive drum 22. In the shown embodiment, said optical means includes an original illumination lamp 2, illumination light reflector 3, first mirror 4, second mirror 5, in-mirror lens 6 and third mirror 7. These members are arranged in the manner known to form an image of the original with a desired magnification. To this end, the reflected beam from the original is directed to the photosensitive drum by the third mirror 7.

The photosensitive drum 22 has an insulating layer on the top surface of the drum. Arranged around the drum are members and devices necessary for image formation on the photosensitive drum. 8 is an integrally formed primary and secondary charger. In the shown copying machine, imagewise exposure is carried out simultaneously with the secondary charging. After imagewise exposure, the whole surface of the drum 22 is exposed to light by a whole surface exposure lamp 10 so that an electrostatic latent image is formed on the drum 22. The latent image is then developed by a known developing device 11. The developer used in this embodiment will be described in detail hereinafter.

The developer contained in the developing device 11 is a colored developing powder composed of thermoplastic resin having a high dielectric constant and magnetic powder having magnetic loss property. The latter mentioned component consists of a metal oxide. Therefore, the visualized image with the developer is a mixture of the microwave electric field energy absorbing dielectric material and the magnetic material having the characteristic of magnetic loss by a magnetic field formed by the microwave.

15 is a supply paper stacker containing a stack of recording materials 24 which may be sheets of cut paper. A pick-up roller 16 is brought into operation in response to a determined signal to feed the recording material 24 into the apparatus from the stacker 16. The recording material is guided to the photosensitive drum 22 along a paper guide 17. Since the feeding of the recording material is synchronous with the developed image on the rotating drum 22, the developed image is transferred onto the recording paper 24 with the aid of a transfer charger 18. After transferring, the recording paper 24 is conveyed to a microwave fixing apparatus 20 by a conveyor belt 19. The conveyor belt 19 is so arranged as to pass over near and above the fixing apparatus 20 and convey the recording paper 24, after fixing, to a pair of paper discharge rollers 23. The recording paper 24 is discharged by the pair of rollers 23 into a discharged paper stacker 21 provided outside of the machine. The manner of operation of the fixing apparatus 20 will be described later with reference to FIG. 2.

After transferring, the developer remaining on the drum 22 is cleaned off by a cleaner 12 and then the drum is discharged by a discharger 13 and a discharge lamp 14 to erase the residual electric image. Thus, the drum is returned to it original state. 9 is a blank exposure lamp for forming a latent image bright part. The function of the blank exposure lamp 9 is to prevent development at the time of the optical system being returned back.

Figure 2:
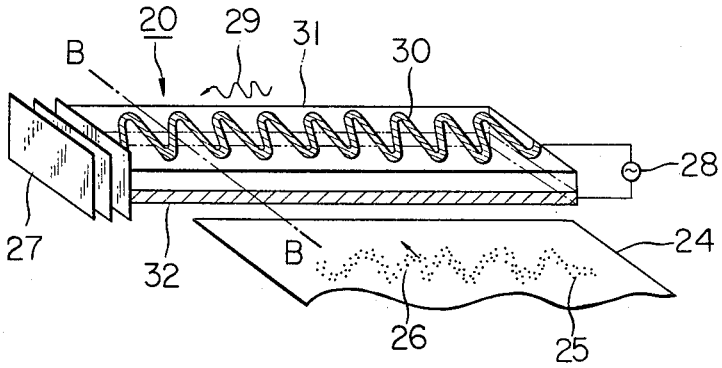
FIG. 2 is a perspective view of the microwave fixing apparatus 20 in the embodiment.
Figure 3:
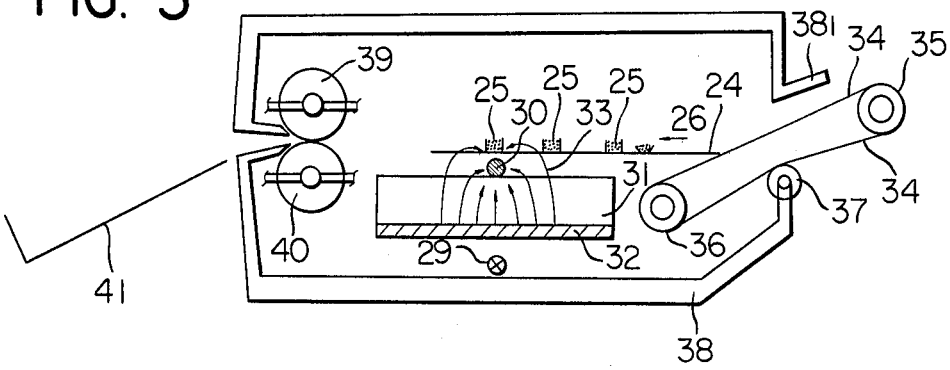
FIG. 3 is a cross-sectional view of the fixing apparatus taken along the line B—B in FIG. 2 with other elements around the fixing apparatus.

FIG. 2 is a perspective of the microwave fixing apparatus 20 and FIG. 3 is a cross section thereof taken along the line B—B in FIG. 2.

Reference numeral 28 is a microwave generating source. The microwave generator 28 is connected to a planar conductor 32 and a zigzag conductor 30. Disposed between the conductors 32 and 30 is a dielectric member 31. The microwave generator 28 is mounted on one end of the dielectric member 31. At the opposite end of the dielectric member there is provided a cooling unit 27 for absorbing any excess microwave radiation and cooling it. The zigzag line conductor 30 extends from the microwave generator 28 to the cooling unit 27 along the length of the dielectric member 31. The direction in which the conductor 30 extends in the form of a zigzag line is normal to the direction of the recording material 24 being conveyed. This direction of the zigzag conductor 30 is hereinafter referred to as the longitudinal direction of the dielectric member 31. The zigzag line conductor 30 divides the upper surface area of the dielectric member 31 into two equal parts. In other words, the conductor 30 is symmetrical in the width in the microwave running direction with respect to the longitudinal axis of the dielectric member 31 and lies in a plane parallel to the planar conductor 32.

Referring to FIG. 3, the fixing apparatus is shown within a shield casing 38. The conveyor belt 34 in FIG. 3 is somewhat different from the conveyor belt shown in FIG. 1. The former is an improved form of the latter.

In FIG. 3, the conveyor rollers 35 and 36 are fixed to a stationary part of the machine and mounted for rotation in the direction of arrow. A conveyor belt 34 is disposed around the rollers 35 and 36. The conveyor belt 34 is kept under tension by a roller 37 rotatably supported by the casing 38. An extension $38_1$ of the casing 38 prevents leakage of microwave radiation. A small clearance is provided between the extension $38_1$ and the belt 34.

On the discharge side of the recording material 24 there are provided a pair of rollers 39 and 40 in contact with each other under pressure. The rollers 39 and 40 are rotatably supported by a stationary part of the machine. The recording material 24 is discharged into tray 41 by the rollers 39 and 40.

The shield casing 38 prevents leakage of microwave radiation from the inner room of the casing. Preferably, the escaping microwave is used to preheat the recording material 24 etc. For this purpose, the rollers 39 and 40 can be formed so as to absorb or reflect microwave. Also, the conveyor belt 34 may be formed of the above mentioned magnetic material which absorbs microwave and generates heat, or a material of high dielectric constant. The casing 38 is preferably made of microwave reflecting material, such as metal, except the inlet and outlet opening parts. These parts of the casing around the inlet and outlet openings are preferably made of microwave reflecting material.

When the operator turns on the copy switch, the above described image forming process, which is, in this case, a electrophotographic copying process, is started. A recording material 24 bearing thereon a developed image 25 corresponding to the original image at any selected magnification enters the fixing station where the above microwave fixing apparatus 20 is arranged.

In the fixing apparatus 20, microwave radiation is concentrated near the zigzag conductor 30 and a concentrated electric field of microwave radiation is formed there. In addition there is formed a concentrated magnetic field by the concentration of microwave radiation at that area. In the prior art microwave fixing apparatus, this concentrated magnetic field has been wasted. According to the invention, this magnetic field serves to fix the developed image 25.

Since, as previously noted, the developed image 25 is formed of dielectric material and magnetic material, the dielectric material generates heat by microwave dielectric loss and also the magnetic material generates heat by microwave magnetic loss simultaneously. Furthermore, the dielectric material itself is heated by the heat generated from the magnetic material by magnetic loss. This further improves the microwave absorbing power of the dielectric material. Therefore, the developed image 25 melts and becomes fixed on the recording material 24 instantly under the combined action of the heat from the dielectric material itself and the heat from the magnetic material. Consequently, as compared with the prior art fixing apparatus with the same microwave output, the embodiment of the invention improves the microwave absorption factor of the developed image and therefore the fixativeness thereof to a great extent. Accordingly, a substantial speed-up of image recording can be attained.

The mechanism of this microwave fixing apparatus will be described in detail.

Generally, when a microwave region alternating electric field is applied to a dielectric material, the dielectric material absorbs the microwave energy as thermal energy and generates heat. This phenomenon is called dielectric loss. Microwave fixing of a developed image is achieved by the melting of a part of the dielectric material contained in the developer and fixing the melted part to the recording material.

The dielectric material in the developer continues to be heated as the result of dielectric loss and a part of the dielectric material begins melting. At this time, the fixing of the developed image begins (this time is referred to as melting start point although a lower melting point component in the developer, if any, has already begun melting before this time).

Heat generation of the dielectric material itself is accelerated by the melting of a part of the dielectric material. At the same time, adjoining developer particles become contacted with each other more closely thereby reducing escape of heat. Therefore, after the melting start point, the whole developed image melts and becomes rapidly fixed on the recording material. Thus, fixing is completed.

The magnetic material component in the developed image according to the invention has the effect of advancing the melting start point. In the microwave concentrated magnetic field, the magnetic material generates heat as the result of magnetic loss and the heat is transmitted to the dielectric material so that heat generation of the latter by dielectric loss is accelerated. Thus, the magnetic material cooperates with the dielectric material to quicken the melting of a part of the dielectric material whereby the developed image is fixed on the recording material in a shorter time and in a more reliable manner.

In other words, according to the above embodiment, the developed image 25 can be fixed on the recording material 24 instantly and surely by dielectric loss and magnetic loss as well as by the synergism of the two. In fact, the conversion efficiency in converting the microwave into fixing energy has been improved to a great extent in experiments using the above embodiment. Also, the fixativeness of the developed image has been found to be very good.

Figure 4:
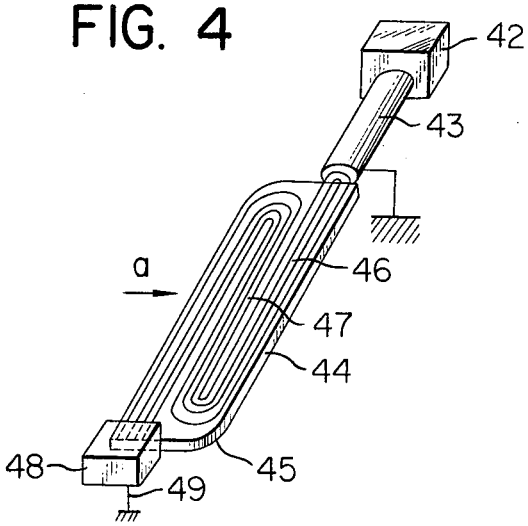
FIG. 4 shows another embodiment of the microwave fixing apparatus.

FIG. 4 shows another embodiment of the microwave fixing apparatus according to the invention.

Item 42 depicts a microwave generator from which microwave is transmitted to a main fixing body 44 through a coaxial cable 43. The center axis of the cable 43 is connected to a conductor 46 arranged on a dielectric base plate 45. The grounding conductor of the coaxial cable is connected to a conductor 47. The main fixing body forms a coplanar guide. A recording material is guided in the direction of arrow a and passes through in the microwave electromagnetic field concentrated on the surface of the base plate 45. Under the action of the electromagnetic field, a developed image on the recording material melts and is fixed to the recording material. 48 is a microwave absorber for absorbing the microwave radiation concentrated in the vicinity of the conductors 46 and 47 and passed over them. The microwave absorber 48 prevents generation of any stationary wave at the main fixing body 44. 49 is a grounding means by which the microwave absorber 48 is grounded.

According to the embodiment, microwave can be applied to the whole area of the recording material and the developed image thereon. Therefore, stability and assuredness in microwave fixing of the developed image can be further improved in this embodiment.

For purpose of explanation, a description will be made hereinafter regarding the heat generation of the above mentioned magnetic material.

In general, high frequency induction heating is mainly induced from eddy current loss and magnetic hysteresis loss in a metal. The applied frequency is in the range of from several Hz to several KHz. In contrast, the magnetic loss in the present invention is approximately equal to the residual loss. The reason for this is that the frequency of microwave applied is in the order of over 1 MHz and the particle size of the developer and the magnetic material is very small.

This residual loss is magnetic loss excluding eddy current loss and magnetic hysteresis loss. More specifically, it is magnetic aftereffect, rotation resonance, magnetic wall resonance, relaxation etc. Since the particle size of the magnetic powder contained in the developed image is very small, eddy current loss is extremely low. Magnetic hysteresis loss decreases its proportion to the total loss with the increasing of frequency of the alternating magnetic field. On the contrary, the residual loss increases. The preferred range of frequencies used in the fixing apparatus of the invention is above 500 MHz. Under these conditions, the proportion of the residual loss to the total loss increases up.

To demonstrate the effect of this invention, some experimental results are given below which were obtained by using the embodiment shown in FIG. 2.

A developer was prepared employing epoxy resin having a softening point of 80° and carbonyl iron powder of particle size less than 1$\mu$. 35% by weight of the carbonyl iron powder was added to the epoxy resin. The resulting mixture was melted and kneaded in a roller mill. The mixture was pulverized at first roughly by a hammer mill and then finely by a jet mill into powder of 5 to 20$\mu$ in particle size. This powder was used as the developer.

A developed image composed of the above developer was fixed onto a recording paper employing the fixing apparatus shown in FIG. 2. The microwave radiation used for fixing was generated from a magnetron of 2540 MHz and high frequency output 200 W. The time required for fixing was about 1 to 2 seconds. For comparison, a latent image was developed with a control developer containing no magnetic powder and the developed image was fixed in the same procedure as above. It took about 4 to 5 seconds to fix the developed image on the recording paper. Although no magnetic powder was added, the developer used as a control exhibited relatively high fixativeness. This is because the epoxy resin was relatively high in $\epsilon \tan \delta$ and a large amount of dielectric loss was produced in the resin. The relative dielectric constant of the resin at room temperature was $\epsilon r=4.0$, $\tan \delta \approx 0.08$ and $\epsilon \tan \delta=0.32$. Its $2r/\mu r=4$. As compared with common resin of $e_r \approx 2$–3 (such as polyethylene), the epoxy resin has also the effect of intensifying the magnetic field in resin and increasing the magnetic loss of the magnetic material.

As a second experiment, a developer was prepared by adding 20% by weight of $NiFeO_4$ powder to acrylic resin. The added powder was less than $1\mu$ in particle size and the imaginary part of complex relative permeability (which is called also relative permeability) was $\mu'' \approx 8$ at about 2.45 GHz. The mixture was pulverized in the same manner as above into a developer powder having an average particle size of about $15\mu$. As a control, a developer containing no magnetic magerial was prepared in the same manner.

The two developers were compared with respect to fixativeness. Microwave output used for fixing was 250 W. The result was that the fixing time required for the developer containing the magnetic powder was about 5 to 8 seconds shorter than the fixing time for the control developer without magnetic material.

Examples of other preferred magnetic materials are:

Ferrox planar (trade name) magnetic material having $\mu''r \approx 20$ at microwave frequency region of 2.45 GHz; NiZn ferrite of $\mu''r \approx 5$; and MnMg system ferrite of $\mu''r \approx 1$.

The frequency used is never limited to 2.45 GHz only. A magnetic field (in this case, it is electromagnetic field) of lower frequency region may be used. Of course, magnetite $Fe_3O_4$ and similar materials also may be used. Preferably the developer has a value of $\mu''$ more than 0.1.

By suitably adjusting the mixture ratio or other factor of the developer while dispersing suitable magnetic pyrogenic particles into the developer there can be obtained a developer which has a peak of magnetic loss absorption within the range of microwave frequency. In view of fixing performance, frequencies above 500 MHz are preferred.

As a third experiment, a developer was prepared employing polyol×450 resin (softening point: 97° C.: supplier: Shell Chemicals) and NiZn ferrite ($\mu''r \approx 5$ in 2.45 GHz microwave magnetic field and particle size: about $0.8\mu$). 33% by weight of the ferrite was added to the polyol resin. The developer was compared with a control developer prepared without addition of the ferrite powder. For the developer containing the magnetic material, it was fixed completely within about three seconds. In contrast, the control developer without magnetic material could not be fixed even after five seconds.

As understood from the above, if one tries to find any suitable resin for dielectric heating fixing which has a large dielectric loss as in the case of prior art, then the selection range of resin is very limited. In addition, it has been extremely difficult to obtain the desired very large dielectric loss from the selected material. According to the invention, a magnetic powder is added to thermoplastic resin as a component of the developer to make use of magnetic loss. By using such developer, the microwave energy loss is increased up to a great extent and the heat generating efficiency is remarkably improved thereby improving, the fixativeness of the developer. The recorded images obtained by microwave fixing according to the invention are superior to those as obtained by pressure fixing or heated roller fixing in image faithfulness as well as in image quality. It is possible by the present invention to provide an image forming process with which image recording can be carried out at higher speed and at any desired time. Further, this invention makes it possible to provide a recording apparatus which is simple in structure and small in size.

In the above shown embodiment, the zigzag conductor 30 carries microwave radiation along a zigzag course as indicated by the arrow 29 and forms many concentrated magnetic fields per unit width of the recording material. With this arrangement, microwave magnetic field energy is applied uniformly to the whole area of the recording material.

Therefore, the developed image is fixed to the recording material uniformly and without any irregularity of fixing. The conductor 30 can transmit the microwave also in the direction of running of the recording material because of the zigzag line form of the conductor. Therefore, the fixing area can be broadened and good, uniform fixing is always assured even when the recording material is moved at high speed.

In case of the prior art microwave fixing apparatus, the miniatuarization of the apparatus as a whole is limited by the wavelength of microwave magnetic field. According to the invention present, miniatuarization can be attained without losing the advantage of improved fixativeness and excellence in fixing uniformity. In the prior art, any magnetic material contained in a developer has exhibited an adverse effect on fixativeness of the developer. On the contrary, in the present invention, the magnetic powder in the developer is positively used to improve the fixativeness of the developer by making the developed image absorb the microwave magnetic energy so as to generate heat by it. Thus, the present invention has provided a novel and very desirable image forming apparatus.

We, the inventors of the present invention have made a vast study on suitable developer and suitable additive magnetic powder for microwave fixing. The results of our studies will be described hereinafter with reference to FIGS. 5 to 7. In summary, the following developers have been found to be most preferable:

(1) A developer for microwave magnetic field fixing, which is characterized in that the developer contains more than 20% by weight of magnetic powder of a particle size less than $1\mu$ dispersed, into the developer particles and the value of $\mu''r$ of the magnetic powder at the frequency range of the fixing microwave magnetic field is above 0.1.

(2) A developer for microwave magnetic field fixing, which is characterized in that the developer contains more than 20% by weight of magnetic powder of a particle size less than $1\mu$, dispersed in the developer particles and the value of $\mu''r$ of the developer at the frequency range of the fixing microwave magnetic field is above 0.1.

Examples of the magnetic powder added as magnetic loss source in the developer include:

Carbonyl iron, magnetite, Ni-Zn system ferrite, $NiFe_2O_4$ ferrite, $Co_2Z$, MnMg system ferrite, MnZn system ferrite, γ-hematite, NiCnZn ferrite and Ferrox planar.

To illustrate the invention the following examples are given.

Evaluation of fixing was conducted by the following procedure:

After fixing, the image on the recording material is rubbed with finger, nail, cloth, tissue paper etc. After rubbing, the image quality is visually observed for ranking. For ranking, five different grades are used which are Rank 1, 2, 3, 4 and 5 as explained below. The final evaluation rank is determined by the mean value of several runs. Among the five ranks Rank 1 is the least desireably and Rank 5 is the most desireably Fixing evaluation is ranked up according to the resistance against rubbing with finger, tissue paper, cloth and nail in this order.

Rank 5: The fixed image remains unerased from recording material by any rubbing with finger, tissue paper, cloth and nail.

Rank 4: The fixed image is slightly erased from the recording material only by a strong rubbing with nail.

Rank 3: The fixed image is slightly erased from the recording material by a strong rubbing with cloth.

Rank 2: The fixed image is partly erased from the recording material by a slight rubbing with tissue paper or finger.

Rank 1: The fixed image is almost completely erased from the recording material by a slight rubbing with tissue paper or finger.

A most common cause for erasion of fixed images is rubbing between paper and paper (with tissue paper or with another recording paper). Ranks 5, 4 and 3 mean that the fixed images are resistable against such rubbing with tissue paper or another recording paper. Therefore, fixing as ranked in Rank 3, 4 or 5 may be considered good in fixativeness and image quality.

Figure 5:
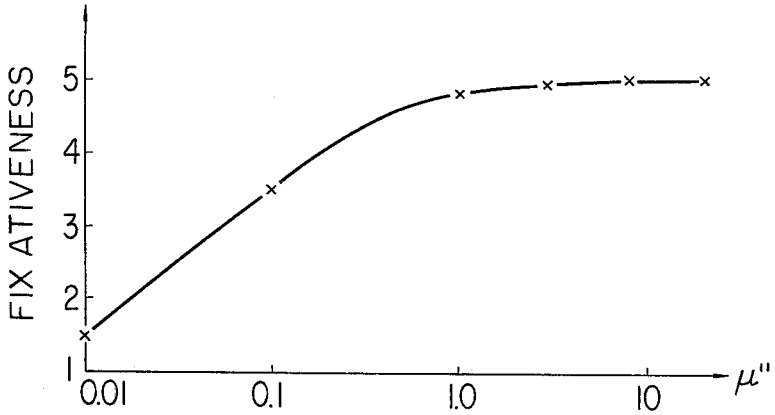
FIG. 5 is a relation curve between imaginary part of complex specific permeability of magnetic powder ($\mu''r$) and fixativeness.

FIG. 5 shows data concerned with the relative permeability of magnetic powder $\mu''r$. In the following examples, the apparatus shown in FIG. 4 was used.

EXAMPLE 1

A 200 W output magnetron (2.45 GHz) was used as the microwave source.

Developers were prepared from a mixture of epoxy resin and magnetic powder with the content of the magnetic material being 30% by weight of the finished developer. Magnetic materials used were $NiFe_2O_4$ having $\mu''r \sim 8$ at the above frequency, Ferrox planar (trade name: supplied by Philips) having $\mu''r \sim 20$, NiZn system ferrite having $\mu''r \sim 5$ and MnMg system having $\mu''r \sim 1$.

The recording paper bearing an image developed with the above developer was passed over the fixing apparatus at a speed of 50 mm/sec to fix the developed image on the recording material. Data concerning the relation between fixativeness and relative permeability $\mu''r$ obtained from this example are shown in FIG. 5.

As seen from the relation curve, good fixativeness can be attained when $\mu''r \geqq 0.1$ (in particular $\mu''r \geqq 1.0$). $\mu''r \sim 0.1$ is therefore a boundary. The reason for this may be considered as follows:

Before fixing, a developed image on the recording paper is in such state in which the developer of 10μ in particle size is laying on the surface of the recording paper in 1 to 10 layers. The contact area between the developer surface and the air layer is relatively large. Therefore, if the magnetic loss of the magnetic powder is lower than a certain limit value, the heat generated in the developer is easily dissipated in air from the surface of the developer and it is no longer possible to increase up the temperature to the desired level for good fixing.

The relative permeability of the developer is variable depending on the content of the magnetic material. Therefore, to attain good and stable fixativeness, it is desirable that the finished developer should have a value of $\mu''r$ higher than 0.1 and preferably higher than 1.0. It is possible to bring the peak of $\mu''r$ to any desired frequency range by suitably adjusting the mixing ratio of magnetic material to resin in the developer.

A comparative test was also conducted using a developer containing magnetic material and a developer without magnetic material. The developer was prepared using Polyol×450 resin (softening point: 97° C., supplied by Shell Chemicals). The magnetic material used was NiZn ferrite (particle size: about 0.5μ) which has a value of $\mu''r \sim 5$ in the microwave magnetic field of 2.45 GHz. One developer contained such magnetic material in an amount of 33% by weight of the developer. Another developer (control) contained no magnetic material and was composed of the above polyol resin.

The fixativeness of the image attained by the developer containing the magnetic material was two ranks better that by the control developer containing no magnetic material.

EXAMPLE 2

Samples of developer were prepared varying the content of magnetic material i.e., 0 wt.%, 10 wt.%, 20 wt.%, 30 wt.%, 40 wt.% and 50 wt.%. The magnetic powder component of the developer was Ni-Zn system ferrite and the resin component was phenol resin. Externally added to the mixture was about 1% of silica ($SiO_2$).

Images formed by the above developers on a recording paper were fixed at a fixing speed of 50 mm/sec with a microwave generator having an output of 200 W. The results obtained are shown in FIG. 6.

Figure 6:
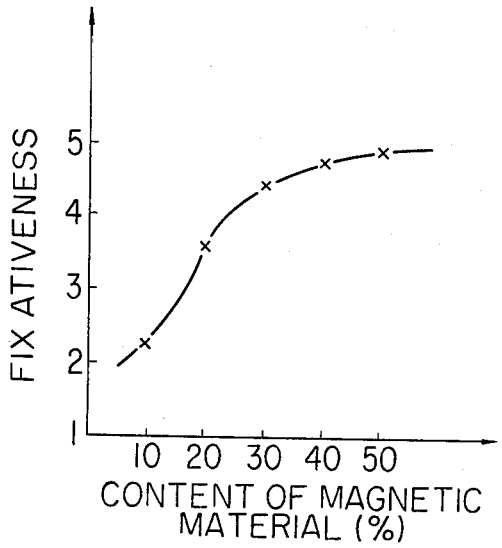
FIG. 6 is a relation curve between content of magnetic material in developer and fixativeness.

As seen in the relation curve in FIG. 6, the fixativeness increases sharply at the content of magnetic powder near 10 to 20 wt.%. At the area higher than 20 wt.%, the relation curve describes a gentle slope. The rise-up of the curve at the area near the content of 10 to 20 wt.% may be explained as follows:

The thermal conductivity of resin itself is generally low. The frequency of microwave is in the order of MHz. In this range of high frequency, the magnetic loss by which the magnetic powder generates heat is mainly constituted of residual loss such as magnetic aftereffect. As the thermal conductivity of resin is low, it takes relatively long time for the generated heat to be transmitted to the whole of resin from the magnetic powder. It is likely that the rise of the curve in FIG. 6 is attributable to the thermal conduction and the escape of heat from the developer surface. Of course, the relation between fixativeness and content of magnetic material is affected by the fixing speed. It has been found that a higher content of magnetic material becomes preferable with an increase in the feeding speed of the recording material.

Also, the content of magnetic material is variable depending on factors other than fixativeness, such as characteristics relating to developing and cleaning, /or type of transfer system. Generally speaking, the range of magnetic material content is from 20% to 80% by weight and preferably from 30% to 60% by weight and more preferably from 30% to 50% by weight.

EXAMPLE 3

Samples of developer containing magnetic powder (carbonyl iron) and resin (phenol resin) were prepared. The content of magnetic powder was 30% by weight. About 1% of silica ($SiO_2$) was externally added to the developer. The particle size of the finished developer was in the range of from 5 to 15μ (mean particle size: 9μ). Magnetic powders having different particle sizes, 2μ, 1μ, 0.5μ and 0.1μ were used for different samples of the developer. In every case, the magnetic powder was dispersed in the resin. With these samples of developer, fixativeness evaluation tests were conducted in the same manner as in Example 1 (output of microwave generation: 200 W; fixing speed: 50 mm/sec). The results of the tests are shown in FIG. 7.

Figure 7:
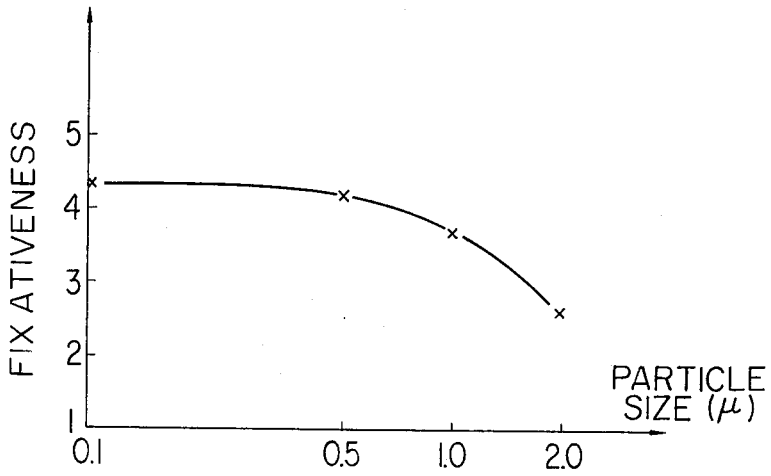
FIG. 7 is a relation curve between particle size of magnetic powder and fixativeness.

The relation curve in FIG. 7 shows that the fixativeness of the developer is variable depending on the mean particle size of the magnetic powder used in the developer. This difference in fixativeness is attributable to the difference in time required to transmit the heat to the resin from the magnetic powder the temperature of which is raised by microwave heating.

For example, when there are two powders in the same amount which are different from each other only in particle size, the powder of smaller particle size has a larger surface area than that of larger particle size does. Therefore, the former will bring about essentially better heat transmission efficiency than the latter.

The fixativeness is variable also depending on the depth up to which the electromagnetic wave can penetrate the interior of the magnetic material. The skin depth at which the intensity of electromagnetic wave becomes 1/e is represented by $\sqrt{2/(2\pi fk\mu)}$. As will be readily understood from the formula, the skin depth is decreased with increasing of any of frequency f, permeability μ and electroconductivity k. As the frequency of microwave used in the invention is high, the effect of the skin depth on the energy conversion rate is not negligible. It is evident that the microwave energy can be converted into thermal energy more efficiently with smaller particle size of magnetic powder for the same amount.

FIG. 7 also shows that a distinct difference in fixativeness appears between the side of smaller particle size than 1μ and the side of larger particle size than 1μ. This means that the critical point as to fixativeness exists at about 1μ of particle size of 1. When the particle size of the magnetic powder is larger than 1μ, the ratio of the particle size of the magnetic powder to the particle size of the developer becomes larger than 1/10. Under these conditions, the state of dispersion of the magnetic powder in the developer is not good. The decline in fixativeness at the side of larger particle size than 1μ may be attributable to the bad dispersion state of the magnetic powder. Heat transmission from the inside of magnetic powder to the resin of developer is very easily affected by the dispersion state of the magnetic material as compared with the case of heat transmission of externally applied thermal energy.

The intensity of the magnetic field around the magnetic material can be increased by use of a larger relative dielectric constant of material as the material (resin etc.) by which the magnetic particle is enclosed. Let the dielectric constant of the material surrounding the magnetic material be ε, its permeability be μ and the intensity of the electric field of electromagnetic wave be E. Then, the above mentioned magnetic field intensity H is given by: $H=\sqrt{\epsilon/\mu}\times E$ Therefore, the magnetic field around the magnetic material can be intensified by using a larger value of $\sqrt{\epsilon/\mu}$ for the material surrounding the magnetic material. Thereby, the magnetic loss also can be increased and the microwave energy can more effectively converted into thermal energy. The value of (relative dielectric constant)/(relative permeability) for the material surrounding the magnetic powder is preferably greater than 3 and more preferably greater than 4. Preferably this material is a dielectric resin having a relative dielectric constant than 3 and more preferably greater than 4. The resin constitutes the main component of the developer. In view of simple construction of the developer, thermoplastic resin is preferred.

The developer used in the invention has to absorb magnetic energy and generate heat. In the developer, the dielectric heating effect of the main commponent resin is, of course, important. To obtain good dielectric heating effect, it is desirable for the resin to have a larger value of εrtanδ. The value is preferably larger than 0.03 and more preferably larger than 0.1. The lower the softening point of the resin is, the smaller the energy necessary for fixing becomes. From this point of view, it is preferable that the softening point is below 100° C.

The above requirements are also applied to the magnetic powder itself. Magnetic powder Mn-Zn ferrite (μ'r~2) and magnetic powder Ni-Zn ferrite (μ''r~2) are equally useful for improvement of fixativeness of the developer according to the invention. However, if the two magnetic materials are compared each other more specifically, then it will be found that they are different in the value of εrtanδ. The value of the former is 2 whereas that of the latter is 0.3. This means that Mn-Zn ferrite has a larger dielectric loss and is more effective in improving the fixativeness than Ni-Zn ferrite.

As previously mentioned, the term "microwave" as used herein means high frequency wave higher than 1 MHz. However, the use of microwave in the frequency range of 1 to 10 MHz is disadvantageous for image forming apparatus. It needs high output and therefore it makes the apparatus expensive in particular when a small size apparatus is desired. To solve the problem it is preferred to use higher frequency microwave than 100 MHz. Microwave radiation which has a frequency higher than several hundreds MHz are more preferred. Microwave radiation of 900 MHz commonly used in the United States and microwave radiation of 2.4 KGHz used in Japan are very suitable for the fixing apparatus according to the invention.

As fully understood from the foregoing, the fixing apparatus of the invention has many advantages over the prior art. In the apparatus of the invention, the applied microwave radiation is more effectively absorbed into the developed image than in the prior art apparatus whatever the output and frequency might be. According to the invention, therefore, the fixativeness and the fixing energy efficiency of microwave radiation can be improved to a great extent as compared with the conventional apparatus. Images can be recorded on any recording material with high image quality.

What is claimed is:

1. An image recording apparatus with microwave fixation comprising:

means for forming a developed image on a recording material, said developed image being formed by a thermoplastic developer having a mixture of a first component and a second component, said first component being a dielectric material having the property of increasing microwave absorption efficiency as the temperature of said first component increases and capable of generating heat by dielectric loss when microwave energy is absorbed, said second component being a magnetic material capable of generating heat by magnetic loss so as to heat said first component to advance the microwave absorption efficiency of said first component and to concentrate the microwave energy itself on said developed image; and means for applying microwave energy to the recording material bearing said developed image and for microwave fixing said developed image onto said recording material.

2. An image forming apparatus as set forth in claim 1, wherein said microwave fixing means includes means for generating microwave radiation of higher frequency than 1 MHz and means for applying said generated microwave radiation to said recording material and developed image.

3. An image forming apparatus as set forth in claim 2, wherein said microwave fixing means further includes means for absorbing the microwave radiation passed over said application means.

4. An image forming apparatus as set forth in claim 1, wherein said second component is a magnetic powder.

5. An image forming apparatus as set forth in claim 4, wherein the particle size of said magnetic powder is less than $1\mu$.

6. An image forming apparatus as set forth in claim 5, wherein the particle size is less than $0.1\mu$.

7. An image forming apparatus as set forth in any of claims 4, 5 and 6, wherein the value of $\mu''r$ of said magnetic powder is above 0.1 wherein $\mu''r$ is the imaginary portion of complex relative permeability.

8. An image forming apparatus as set forth in claim 7, wherein the value of $\mu''r$ is above 1.

9. An image forming apparatus as set forth in claim 4, wherein the content of said magnetic powder is in the range of from 20 to 80% by weight of the developer.

10. An image forming apparatus as set forth in claim 9, wherein the content of said magnetic powder is in the range of from 30 to 60% by weight of the developer.

11. An image forming apparatus as set forth in claim 9 or 10, wherein the particle size of said magnetic powder is less than $1\mu$.

12. An image forming apparatus as set forth in claim 11, wherein the particle size of said magnetic powder is less than $0.1\mu$.

13. An image forming apparatus as set forth in claim 11, wherein the value of $\mu''r$ of said magnetic powder is above 0.1.

14. An image forming apparatus as set forth in claim 13, wherein the value of $\mu''r$ of said magnetic powder is above 1.

15. An image forming apparatus as set forth in claim 12, wherein the value of $\mu''r$ of said magnetic powder is above 0.1.

16. An image forming apparatus as set forth in claim 15, wherein the value of $\mu''r$ of said magnetic powder is above 1.

17. An image forming apparatus as set forth in claim 1 or 4, wherein said first component is dielectric material.

18. An image forming apparatus as set forth in claim 17, wherein the relative dielectric constant of said first component is above 3.

19. An image forming apparatus as set forth in claim 18, wherein the relative dielectric constant of said first component is above 4.

20. An image forming apparatus as set forth in claim 17, wherein said first component is such material whose value of relative dielectric constant/relative permeability is above 3.

21. An image forming apparatus as set forth in claim 20, wherein said first component is such material whose value of relative dielectric constant/relative permeability is above 4.

22. An image forming apparatus as set forth in claim 1 or 4, wherein said second component is dielectric material and its dielectric loss $\epsilon r \tan\delta$ is above 0.03.

23. An image forming apparatus as set forth in claim 22, wherein the dielectric loss $\epsilon r \tan\delta$ of said second component is above 0.1.

24. An image forming apparatus as set forth in claim 17, wherein said second component is dielectric material and its dielectric loss $\epsilon r \tan\delta$ is above 0.03.

25. An image forming apparatus as set forth in claim 24, wherein the dielectric loss $\epsilon r \tan\delta$ of said second component is above 0.1.

26. An image recording apparatus according to claim 1, 5 or 9 wherein said microwave fixing means comprises a dielectric base, a conductor for concentratingly propagating microwave disposed on the surface of said base along the direction intersecting the direction transmiting the recording material, and means for transmitting the recording material in contact with or in the vicinity of said conductor.

27. A recording apparatus according to claim 1, wherein said thermoplastic developer includes as said second component fine particles of more than 20 percent by weight of magnetic material having particle size of less then $1\mu$ and imaginary part of complex relative permeability $\mu''$ of more than 0.1.

* * * * *

UNITED STATES PATENT AND TRADEMARK OFFICE

CERTIFICATE OF CORRECTION

PATENT NO. : 4,482,239

DATED : November 13, 1984

INVENTOR(S) : NAGAO HOSONO, ET AL.

It is certified that error appears in the above-identified patent and that said Letters Patent is hereby corrected as shown below:

On the title page, in the Abstract, line 5, delete "of".

Column 3, line 59, "it" should read --its--.

Column 4, line 55, "a" should read --an--.

Column 8, line 3,4, after "improved" insert --,--; after "improving" delete ",";
line 33, "invention present" should read --present invention--;
line 54, "1μ dispersed," should read --1μ, dispersed--.

Column 9, line 14, "desireably" (first occurrence) should read --desirable--; "desireably" (second occurrence) should read --desirable--.

Column 10, line 24, after "composed" insert --only--;
line 28, insert --than-- before "that";
line 54, after "takes" insert --a--;
line 67, insert --,-- after "developing"; delete "and"; delete "/".

Column 11, line 51, "1μ of particle size of 1" should read --particle size of 1μ.--.

UNITED STATES PATENT AND TRADEMARK OFFICE

CERTIFICATE OF CORRECTION

PATENT NO. : 4,482,239

DATED : November 13, 1984

INVENTOR(S) : NAGAO HOSONO, ET AL.

It is certified that error appears in the above-identified patent and that said Letters Patent is hereby corrected as shown below:

Column 12, line 4, after "E" insert --.--

Signed and Sealed this

*Fourteenth* Day of *January 1986*

[SEAL]

*Attest:*

DONALD J. QUIGG

*Attesting Officer*

*Commissioner of Patents and Trademarks*